United States Patent [19]

Mullin

[11] Patent Number: 4,879,052

[45] Date of Patent: Nov. 7, 1989

[54] HIGH TEMPERATURE POLYOL ESTER/PHOSPHATE ESTER CRANKCASE LUBRICANT COMPOSITION

[75] Inventor: Geralyn Mullin, Yonkers, N.Y.

[73] Assignee: Akzo America Inc., New York, N.Y.

[21] Appl. No.: 233,773

[22] Filed: Aug. 19, 1988

Related U.S. Application Data

[63] Continuation of Ser. No. 122,476, Nov. 5, 1987, Pat. No. 4,780,229.

[51] Int. Cl.[4] ..... C10M 137/04

[52] U.S. Cl. ..... 252/32.5; 252/56 S

[58] Field of Search ..... 252/32.5, 56 S

[56] References Cited

U.S. PATENT DOCUMENTS

| | | | |
|---|---|---|---|
| 3,694,382 | 9/1972 | Kleiman et al. | 252/56 S |
| 3,720,612 | 3/1973 | Bosniak et al. | 252/32.5 |
| 3,992,309 | 11/1976 | Dounchis | 252/49.8 |
| 4,087,386 | 5/1978 | Dounchis | 252/49.8 |
| 4,320,018 | 3/1982 | Yaffe | 252/56 S |
| 4,362,634 | 12/1982 | Berens et al. | 252/49.5 |
| 4,440,657 | 4/1984 | Metro et al. | 252/49.9 |
| 4,780,229 | 10/1988 | Mullin | 252/32.5 |

*Primary Examiner*—Jacqueline V. Howard

*Attorney, Agent, or Firm*—Richard P. Fennelly; Louis A. Morris

[57] ABSTRACT

Novel polyol ester/triaryl phosphate ester blends comprising a third liquid component are disclosed. They have particular utility as ultra high temperature lubricants, at temperatures in excess of 1000° F. Preferred component compositions and percent weight ranges are also disclosed.

3 Claims, 1 Drawing Sheet

(LIQUID-BASED CRANKCASE ADDITIVE SYSTEM)

KEY: □ PRIOR ART COMPOSITIONS

○ EXAMPLES OF INVENTION

X COMPARATIVE EXAMPLES

HIGH TEMPERATURE POLYOL ESTER/PHOSPHATE ESTER CRANKCASE LUBRICANT COMPOSITION

This is a continuation of application Ser. No. 122,476, filed Nov. 5, 1987, now U.S. Pat. No. 4,780,229.

BACKGROUND (i) Field of the Invention

The present invention relates to a novel ultra high temperature lubricant composition. It also relates to a process for improving the performance of adiabatic diesel engines. More particularly, it relates to specific blends of (A) polyol esters; (B) triaryl phosphate esters: and (C) crankcase additive systems.

(ii) Prior Art

This paragraph summarizes the nature of the prior art without identifying the specific documents, etc. The prior art discloses each of the three individual liquid components that may be blended together to form the blends of the present invention shown in all the Examples of the invention below. However, the prior art does not appear to disclose any specific blend comprising at least some of all three components. Thus, polyol esters (hereinafter "A"), triaryl phosphate esters (hereinafter "B"), and additive systems in mineral oil (hereinafter "C"), are all, individually, old in the art. The prior art also discloses lubricants that have been formed from A/B blends and crankcase lubricants formed from A/C blends. However, the known prior art does not contain any working examples of A/B/C blends. Even less does the prior art recognize critical ranges therein for ultra high temperature lubricants. Further, the prior art does not appear to contain any working examples of an A/B blend comprising B within the range from 20 to 60 weight percent. Nowhere does the known prior art disclose a crankcase lubricant that operates satisfactorily in newly developed diesel engines that operate without any forced cool cooling system at temperatures in excess of 1000° F., and "approach adiabatic" conditions. For the purpose of this specification the term "adiabatic" is broadly defined to include "approaching adiabatic".

Specific items of prior art are now discussed in the following paragraphs.

Engines are now being developed which have operating temperatures within the range 1000°-2500° F. For example, see "The Amazing Ceramic Engine Draws Closer" by John W. Dizard at pages 76-79 of "Fortune", July 25, 1983. The article focuses on the use of ceramic parts, but says little about how such engines are lubricated.

Lubrication problems of adiabatic engines have been briefly discussed in Stauffer Chemical Company's Technical folder "Stauffer's New SDL-1 ™". Under the section headed "High Temperature Operation" concerning adiabatic diesel engines, the following is stated:

> ". . . This new engine development has been frustrated to some extent by the poor stability of standard mineral oil based lubricants. Attempts to satisfy the engine with synthetic hydrocarbon products also proved unsuccessful. Stauffer SDL-1 was the only lubricant to function satisfactorily in this very high temperature environment."

Stauffer's Technical folder also notes that the lubricant used comprised a 100% polyol ester base (containing no diesters or synthetic hydrocarbons). In addition it comprised about 10% by weight of a mineral oil additive system similar to C used in the examples of the invention hereinafter. Accordingly it was a lubricant of the A/C type.

Triaryl phosphate esters (i.e. component B of the invention) have been used for many years, in lubrication of air compressors and industrial gas turbines, and in a variety of hydraulic systems where fire resistance is required.

Disclosures of A/B blends include those found in U.S. Pat. No. 3,992,309 (Dounchis); and in U.S. Pat. No. 4,440,657 (Metro).

Dounchis' claims 8-11 are of interest to the present invention. However, Dounchis does not appear to have any working example directed to any A/B blend wherein the volume percent of B is less than 65% is shown in Dounchis'Example V.

Metro discloses an A/B blend wherein B is present in an amount of up to 5% by weight. It is believed that Metro (filed 1982) implicitly contains negative teachings relative to the present invention.

U.S. Pat. No. 4,362,634 (Berens, assigned to Stauffer Chemical Company) is of interest in that it relates to an A/B/"D" blend wherein D is a specific surfactant and the components are present in the weight percent ranges (60-90)/(1-10)/(5-30). However the blend is used in aqueous emulsions as a metal working lubricant and has only a very low viscosity.

In sum, essentially the prior art does not disclose any working example of any blend which comprises B within the range of from above 10% to below 65%. Even less does the prior art recognize the existence of the criticality of a narrow range of 20 to 50% weight percent of B, when third component C is present.

SUMMARY OF THE INVENTION

In contrast to the aforementioned prior art there has now been surprisingly discovered the following. Firstly, certain A/B/C blends can be prepared that are stable at room temperature, even though the corresponding B/C blends are quite unstable at the 99/1 level. Secondly, such blends appear to be better lubricants for ultra high temperature operation than the prior art products. In its broadest aspect the composition of the present invention is: A high temperature crankcase lubricant composition comprising:

(A) at least 5 weight percent of a polyol ester derived from the esterification of an aliphatic polyol with an aliphatic carboxylic acid, wherein said aliphatic carboxylic acid is (i) an aliphatic monocarboxcylic acid of 4 to 18 carbon atoms; or (ii) a mixture of an aliphatic monocarboxylic acid of 4 to 18 carbon atoms and an aliphatic dicarboxylic acid of 3 to 12 carbon atoms, with the proviso that the proportion of dicarboxylic acid in said mixture is such that on the average not more than one of the average number of hydroxyl groups in the polyol in esterified by said dicarboxylic acid;

(B) at least 20 weight percent of a triaryl phosphate ester represented by the formula:

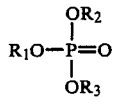

wherein $R_1$, $R_2$ and $R_3$ may be the same or different radical selected from the group consisting of phenyl, cresyl, xylyl, toluyl, isopropylphenyl, tertiary butylphenyl, tertiary nonylphenyl and secondary butylphenyl; and (C) a crankcase additive system in an amount up to 40 weight percent, subject to the proviso that the blend not be incompatible as evidenced by absence of haziness after standing for 24 hours at a temperature of 10° F.

THE DRAWING

FIG. 1 is a Roozeboom triangular diagram whose points represent (1) compositions of the Examples of the invention; or (2) compositions of the prior art; or (3) compositions of the Comparative Examples herein.

DESCRIPTION OF THE PREFERRED EMBODIMENTS

Figure 1:
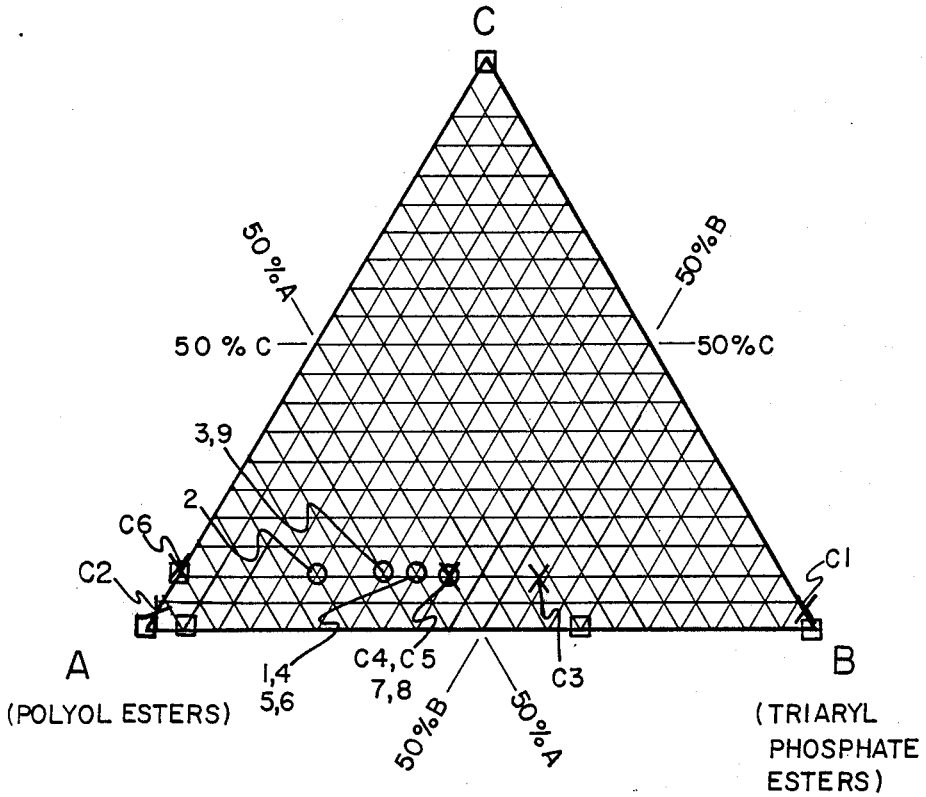

The preferred embodiments of the invention are shown in the claims hereinafter. They are illustrated by the Examples contrasted with both the prior art and the Comparative Examples below.

It will be appreciated that the invention is also far broader than the few Examples shown herein, as discussed below with regard to components A, B, and C.

Component A of the present invention is a polyol ester such as conventionally used in crankcase lubricants based upon such esters. The polyol ester component of the present invention can comprise about 5% to about 75%, preferably from about 50% to about 70%, of the lubricant composition. The polyol ester is formed by the esterification of an aliphatic polyol with a carboxylic acid. The aliphatic polyol reactant contains anywhere from about 3 to about 25% carbon atoms and has from about 3 to about 8 esterifiable hydroxyl groups. Examples of some polyols which can be used included trimethylol propane, pentaerythritol, dipentaerythritol, tripentaerythritol, and mixtures of these polyols. The carboxylic acid reaction can be selected from either aliphatic monocarboxylic acids or mixtures of aliphatic monocarboxylic acids and aliphatic dicarboxylic acids. The monocarboxylic acid can contain from about 4 to about 18 carbon atoms and mixtures of such acids can be used if desired. Representative examples of acids include hexanoic acid, heptanoic acid, nonanoic acid, and mixtures of these acids. Mixtures of monocarboxylic acid and dicarboxylic acid can be used if an increased viscosity is desired in the final product. Generally the proportion of dicarboxylic acid in the monocarboxylic acid/dicarboxylic acid mixture will be limited by the proviso that on the average not more than one of the average number of hydroxyl groups in the polyol will be esterified by the carboxylic acid. Suitable dicarboxylic acids are aliphatic acids of from 3 to 12 carbon atoms. Some representative dicarboxylic acids include adipic and azelaic acid.

The phosphate ester material (component B) that is used in the present composition is a triaryl phosphate wherein the aryl portion can be either a substituted or unsubstituted aryl group. Representative aryl moieties include phenyl, cresyl, xylyl, toluyl, isopropyl phenyl, t-butylphenyl, t-nonylphenyl, and sec-butylphenyl. The triaryl phosphate that is used generally constitutes from about 15% to about 40%, preferably from about 30% to about 40% by weight of the present composition.

Any crankcase additive system may be used as C in this invention, subject to the following provisos. It is essential that the blend not be hazy to the eye after standing for 24 hours at a temperature of 10° F. "Haziness" indicates that the blend is incompatible. It is preferred that no film form on the upper surface of the blend after standing for 24 hours at 10° F., as detected by the eye. "Film formation" is an indication that the blend is not completely compatible. It is preferred that the additive system comprise a crankcase detergent inhibitor. It is preferred that it be at least an SE/CD additive system. One preferred system (as shown in Examples 6–9 and 6-R below) is a mineral oil based additive system. However, it is believed that an even more preferred system (still to be made) would be one that uses a triaryl phosphate ester base rather than a mineral oil base (see discussion of Example 6-R below). At least when a mineral oil system is used, it is preferred that it comprises an organic compound and a metallo organic compound in a mineral oil base; and more preferably comprises about 0.2 weight percent boron; about 0.8 weight percent calcium: about 0.9 weight percent magnesium; about 0.8 percent nitrogen; about 1.0 weight percent phosphorus; and about 1.1 weight percent zinc; and has a has a viscosity at 210° F. of about 650 SUS, and a TBN of about 77 mg KOH/g.

In order that the composition of the present invention has the greatest degree of utility, it is desirable to also include, as an additive, such conventional materials as dispersants, antioxidants, antiwear agents, overbasing materials, metal passivators and the like.

The groups of Examples given below parallel the sequence followed in the research work, which fell into four phases. In the first phase, experiments were conducted to examine the compatibility of various A/B/C mixtures (without the presence of any dispersant, antioxidant or metal passivator). In the second phase, compatibility and viscosity were both examined (again in the absence of any dispersant, antioxidant or metal passivator). In the third phase, several potential A/B/C candidates containing dispersant, antioxidant and metal passivator were prepared and tested for compatibility and viscosity. A candidate was then selected and subjected to additional conventional testing for properties such as flash point, specific gravity, etc. In the fourth phase, the selected candidate was evaluated (by an outside cooperator under a secrecy agreement) on an experimental adiabatic diesel engine; and compared with the best known prior art lubricant.

Further, the following should be noted concerning the FIGURE and tables.

Table 1 identifies and characterizes all compounds or ingredients that are identified by code letter/number elsewhere in the specification.

Table 2 summarizes the initial compatibility trials ("phase 1" above).

Table 3 summarizes the compatibility/viscosity trials for blends consisting of A,B and C ("phase 2" above).

Table 4 summarizes the compatibility/viscosity trials wherein several additional additives were present ("phase 3" above).

As noted previously, FIG. 1 is a conventional Roozeboom triangular diagram. The following code has been used in FIG. 1. Circles correspond to the inventions shown in the Examples. Crosses correspond to the various Comparative Examples herein. Squares correspond to various compositions of the prior art.

TABLE 1

RAW MATERIALS USED IN VARIOUS BLENDS OF EXAMPLES

| Code | Compound |
|---|---|
| A1 | Trimethylolpropane Tri-isostearate |
| A2 | Trimethylolpropane Tripelargonate |
| B | t-Butyl phenyl diphenyl phosphate |
| C | SE/CD Lube Oil additive** Organic compound & metallic organic compound in oil |
| D1 | Condensation product of dioctylated phenol & polyethylene glycol (dispersant) |
| D2 | Phenyl-alpha-naphthylamine (antioxidant) |
| D3 | Benzotriazole (metal passivator) |

**Chemical and physical inspections are listed in Exxon/Paramins Product Information Bulletin on "The Universal Oil Additive, ECA 7437A". A typical chemical inspection is stated to be as follows, all units being weight percent: 0.17 boron, 0.76 calcium, 0.87 magnesium, 0.78 nitrogen, 1.00 phosphorus, 1.11 zinc, and 8.7 sulfated ash.

EXAMPLE 1 and COMPARATIVE EXAMPLES C1–C3

Four different blends were prepared and tested as summarized in Table 2 below. They are all included in FIG. 1.

TABLE 2

INITIAL COMPATIBILITY TRIALS

| Ex. Ref. No. | C1 | C2 | C3 | 1 |
|---|---|---|---|---|
| Component A1*, wt. % | 0 | 99 | 35 | 53 |
| Component A2*, wt. % | 0 | 0 | 0 | 0 |
| Component A, wt. % | 0 | 99 | 35 | 53 |
| Component B*, wt. % | 99 | 0 | 53 | 35 |
| Component C*, wt. % | 1 | 1 | 10 | 10 |
| Whether compatible | No | Yes | No | Yes |

*See Table 1 for code explanation

The blends were prepared in the following manner. The required amounts of components were added to a clean dry 250 ml beaker. The mixture was stirred with heat at 85° F. for one-half hour. After which heat was turned off. Stirring continued and the blend was observed for compatibility at elevated temperature and at room temperature. The appearance of the blend (whether it is "clear" or "hazy") denotes whether it is compatible or incompatible at the relevant temperature.

The results of Comparative Examples C1 and C2 and Example 1 led to further r trials, including those shown in Examples 2-5 and Comparative Example C4. (Comparative Example C3 was not performed until later.)

EXAMPLES 2–5 and COMPARATIVE EXAMPLE C4

Five blends having different compositions were prepared in the same manner as in Example 1, and tested as summarized in Table 3 below, in viscosity/compatibility trials. The results are also shown on FIG. 1.

TABLE 3

VISCOSITY/COMPATIBILITY TRIALS A/B/C

| Ex. Ref. No. | 2 | 3 | 4 | 5 | C4 |
|---|---|---|---|---|---|
| Component A1*, wt. % | 50 | 50 | 50 | 50 | 50 |
| Component A2*, wt. % | 19.7 | 9.7 | 4.7 | 2.7 | 0 |
| Component B*, wt. % | 19.7 | 29.7 | 34.7 | 36.7 | 39.4 |
| Component C*, wt. % | 10.6 | 10.6 | 10.6 | 10.6 | 10.6 |
| Appearance**, with heat | cl | cl | cl | cl | cl |
| Appearance**, at room temperature | cl | cl | cl | cl | cl |

TABLE 3-continued

VISCOSITY/COMPATIBILITY TRIALS A/B/C

| Ex. Ref. No. | 2 | 3 | 4 | 5 | C4 |
|---|---|---|---|---|---|
| Appearance**, after storage at +10° F. | cl | cl | cl | cl | hazy |
| Viscosity, at 210° F., cS by ASTM D-445 | 10.7 | 10.9 | 11.06 | 11.2 | 11.1 |

*See Table 1 for code explanation.
**cl denotes clear

Note that compatible blends were obtained for the range of B from 19.7 to 36.7 weight percent, but that when the amount of B was 39.4 weight percent, the blend was incompatible.

EXAMPLES 6–9 and COMPARATIVE EXAMPLE C5

Five different blends were then made and extensively tested as shown in Table 4 below. In these trials the A/B/C blends further comprised conventional additives (dispersant, antioxidant, and metal passivator). Also, the testing was broadened to include additional properties that are relevant to the suitability of the blend as a lubricant. The additional tests included those for Viscosity Index; Specific Gravity; TAN; TBN; and Flash Point.

These trials confirmed borderline compatibility conditions were also present at around B levels of 40 weight percent when conventional dispersant, antioxidant, and metal passivator (of the types shown in Table 1) were incorporated into the blend.

TABLE 4**

TRIALS A/B/C PLUS ADDITIVES

| Ex. Ref. No. | 6 | 7 | C5 | 8 | 9 |
|---|---|---|---|---|---|
| Component A1*, wt. % | 48.08 | 48.08 | 45.03 | 48.08 | 48.58 |
| Component A2*, wt. % | 5.0 | 2.0 | 2 | 0 | 10.0 |
| Component B*, wt. % | 35.0 | 38.0 | 41.0 | 40.0 | 30.0 |
| Component C*, wt. % | 10.6 | 10.6 | 10.6 | 10.6 | 10.6 |
| Dispersant,* wt. % | .8 | .8 | .8 | .8 | .8 |
| Antioxidant,* wt. % | .5 | .5 | .5 | .5 | .5 |
| Metal Passivator,* wt. % | .02 | .02 | .02 | .02 | .02 |
| Appearance, with heat | cl | cl | cl | cl | cl |
| Appearance, at room temp. | cl | cl | cl[1] | cl | cl |
| Appearance after storage at +10° F. | cl | cl | cl | cl | cl |
| Viscosity, at 210° F., cS by ASTM D-445 | 11.03 | 11.04 | 11.09 | 10.99 | 10.88 |
| Viscosity, at 100° F., cS by ASTM D-445 | 94.2 | | 93.9 | 97.3 | |
| Viscosity Index | 111 | | 113 | 107 | |
| Pour Point, °F. by ASTM D-97 | −20 | | −15 | | |
| Specific Gravity at 77/77° F. by ASTM D-1217 | 0.99878 | | | | |
| Density lb./gal. | 8.34 | | | | |
| TAN, mgKOH/g by ASTM D-974 | 1.65 | | | | |
| TBN, mg KOH/g by ASTM D-2896 | 8.09 | | | | |
| Flash Point °F./°C. by ASTM D-92 | 420/216 | | | | |

*See Table 1 for code explanation.
**Blanks indicate no testing was performed
[1]Film formed after a 1–2 week storage at room temperature.

EXAMPLE 6-R and COMPARATIVE EXAMPLE C6

Two blends were tested in experimental adiabatic diesel engines by a third party under relevant secrecy/-non-analysis agreements, under conditions that were not precisely identical.

Essentially, the composition of Example 6-R was a repeat of that shown in Example 6. It gave good results(see below). Comparative Example C6 had a composition similar to that of an A/C blend previously proposed by Stauffer Chemical company for use in experimental adiabatic diesel engines, but had given unsatisfactory results in a different experimental engine in earlier trials.

The third party succeeded in running the adiabatic diesel engine at 1100° F. ring liner temperature using the Example 6-R formulation. They reported this result to the Army under their contract obligation, but of course gave no information about the composition of the lubricant or its source. Their written report is public information.

The third party also commented that the frictional characteristics and BSFO (brake specific fuel consumption) of the adiabatic engine was equivalent to a conventional diesel using a conventional lubricant. At equivalent displacement, however, the adiabatic engine produced a higher horsepower rating, is capable of operating on alternate fuels, and has no cooling system to malfunction.

The foregoing Examples of the invention have demonstrated that phosphate esters are viable for use as ultra high temperature crankcase base oils. They have demonstrated superior lubricity in the adiabatic engine and can be formulated with diesel oil additives. It is further predicted that ring belt deposits would be reduced by use of a component C in which an additive system is dispersed in triaryl phosphate ester base rather than mineral oil base.

What I claim is:

1. A process for improving the frictional characteristics and brake specific fuel consumption of an engine operated at temperatures in excess of 1000° F., which comprises the step of lubricating the engine's moving parts with a composition comprising a blend of at least one polyol ester and at least one triaryl phosphate ester in a combined amount of at least 80 weight percent.

2. The process of claim 1 which comprises lubricating with a composition which further comprises additives dispersed in a mineral oil base.

3. The process of claim 1 which comprises lubricating with a composition which further comprises additives dispersed in a base comprising triaryl phosphate esters.

* * * * *